US010688646B2

(12) United States Patent
Frenken

(10) Patent No.: US 10,688,646 B2
(45) Date of Patent: Jun. 23, 2020

(54) METHOD FOR OPERATING A HYDRAULICALLY OPERATED HAND-HELD DEVICE AND HYDRAULICALLY OPERATED HAND-HELD DEVICE

(71) Applicant: GUSTAV KLAUKE GMBH, Remscheid (DE)

(72) Inventor: Egbert Frenken, Heinsberg (DE)

(73) Assignee: GUSTAV KLAUKE GMBH, Remscheid (DE)

( * ) Notice: Subject to any disclaimer, the term of this patent is extended or adjusted under 35 U.S.C. 154(b) by 271 days.

(21) Appl. No.: 15/553,772

(22) PCT Filed: Feb. 5, 2016

(86) PCT No.: PCT/EP2016/052450

§ 371 (c)(1),
(2) Date: Aug. 25, 2017

(87) PCT Pub. No.: WO2016/134951

PCT Pub. Date: Sep. 1, 2016

(65) Prior Publication Data

US 2018/0236649 A1 Aug. 23, 2018

(30) Foreign Application Priority Data

Feb. 27, 2015 (DE) ..... 10 2015 102 806

(51) Int. Cl.
*B25F 5/00* (2006.01)
*B25B 27/10* (2006.01)
(Continued)

(52) U.S. Cl.
CPC ..... *B25F 5/005* (2013.01); *B25B 27/026* (2013.01); *B25B 27/10* (2013.01); *B26F 1/34* (2013.01); *B21J 15/105* (2013.01); *B21J 15/20* (2013.01)

(58) Field of Classification Search
CPC ..... B25F 5/05; B25B 27/026; B25B 27/10; B26F 1/34; B21J 15/20; B21J 15/26; B21D 39/04
(Continued)

(56) References Cited

U.S. PATENT DOCUMENTS 3,817,152 A 6/1974 Viron
5,727,417 A * 3/1998 Moffatt ..... B21F 15/06 72/453.03
(Continued)

FOREIGN PATENT DOCUMENTS

DE 2211288 A1 9/1972
DE 3710863 A1 10/1988
(Continued)

OTHER PUBLICATIONS

Communication on the Transfer of the International Preliminary Report on Patentability for corresponding International Patent Application No. PCT/EP2016/052450 dated Jul. 25, 2017, 44 pages.
(Continued)

*Primary Examiner* — Nathaniel C Chukwurah
(74) *Attorney, Agent, or Firm* — Klintworth & Rozenblat IP LLP

(57) ABSTRACT

A method for operating a hydraulically operated hand-held device is provided. The hand-held device includes a hydraulic pump, a moving part, a fixed part and a return valve with an associated valve seat. The moving part can be displaced into a working position by a build-up of hydraulic pressure produced by filling a hydraulic chamber with hydraulic medium from a storage chamber using the hydraulic pump. The moving part can be automatically moved back from the working position into an end position by opening the return valve, if a predetermined working pressure is reached. The hydraulic pressure acting upon the return valve for trigger-
(Continued)

ing a movement of the moving part into the end position is increased independently of reaching the predefined working pressure.

23 Claims, 7 Drawing Sheets

(51) Int. Cl.
*B25B 27/02* (2006.01)
*B26F 1/34* (2006.01)
*B21J 15/10* (2006.01)
*B21J 15/20* (2006.01)

(58) Field of Classification Search
USPC ..... 173/1
See application file for complete search history.

(56) References Cited

U.S. PATENT DOCUMENTS 6,276,186 B1 8/2001 Frenken
6,401,515 B2 6/2002 Frenken
6,769,356 B2 * 8/2004 Frenken ..... B21J 15/20 100/269.01
7,032,296 B2 * 4/2006 Zdravkovic ..... B21J 15/025 29/243.53
7,908,963 B2 * 3/2011 Frenken ..... B25B 27/10 100/269.01
8,056,473 B2 * 11/2011 Frenken ..... B21D 39/048 100/35
2005/0016375 A1 1/2005 Harwath et al.
2005/0235730 A1 10/2005 Brailovskiy
2009/0133591 A1 * 5/2009 Frenken ..... B25B 27/10 100/269.01
2013/0206022 A1 * 8/2013 Bungter ..... B25B 27/10 100/35

FOREIGN PATENT DOCUMENTS

DE 102008028957 A1 * 12/2009 ..... B25B 27/10
DE 102008028957 A1 12/2009
EP 0944937 B1 3/2002
EP 1249619 A1 10/2002
EP 1564461 A1 8/2005
WO WO2007/018649 2/2007
WO 2008/138987 A2 11/2008
WO 2010/123987 A1 10/2010
WO WO2011/061212 5/2011
WO 2012/055901 A1 5/2012
WO 2014/108361 A1 7/2014

OTHER PUBLICATIONS

Machine translation of WO2011061212A1.
International Search Report for corresponding International Patent Application No. PCT/EP2016/052450 dated Jul. 27, 2016, 7 pages.
Written Opinion for corresponding International Patent Application No. PCT/EP2016/052450 dated Feb. 2, 2017, 11 pages.
Machine translation of DE102008028957A1.
Machine translation of DE3710863A1.
Machine translation of EP1249619A1.
Machine translation of WO2012055901A1.
Machine translation of WO2008138987A2.
Translation of EP0944937B1.
Translation of WO2014108361A1.

* cited by examiner 1
2
4
5
8
9
27
28
28a
28b
II
VII
Ia
K 1
3
23
III
III
35
34
33
32
22
21
24
18
14
11
12
7
29
31
30
15
10
8
6
5
4
16

1
3
23
VI
VI
35
34
33
32
22
21
24
18
14
11
12
7
29
31
30
15
10
8
6
5
4
16

METHOD FOR OPERATING A HYDRAULICALLY OPERATED HAND-HELD DEVICE AND HYDRAULICALLY OPERATED HAND-HELD DEVICE

The invention relates to a hydraulically operated hand-held device and a method for operating same.

Such methods and hand-held devices are known for example from DE 10 2008 028 957 A1, EP 0 944 937 B1 (U.S. Pat. No. 6,276,186 B1, U.S. Pat. No. 6,401,515 B2) and WO 2014/108361 A1.

Such hand-held devices are used for example as pressing devices, preferably for pressing or crimping cable shoes with inserted cable or for pressing pipe-shaped or tubular workpieces. Such hand-held devices can also be used for perforating or punching in particular metal components. Furthermore these hand-held devices can also be configured as riveting devices or other cutting devices.

A hydraulically operated hand-held device in the form of a pressing device is described for example in EP 0 944 937 B1 (U.S. Pat. No. 6,276,186 B1, U.S. Pat. No. 6,401,515 B2). This hand-held device has a return valve which is displaced into a valve open position upon reaching a predefined hydraulic pressure and is held in this position. This results in a back flow of the hydraulic medium which moves the moving part into the working position. The moving part moves back into the base or end position as a result of the lack of or reduced application of pressure. At the latest when reaching this end position, the hydraulic pressure acting on the return valve is reduced in such a manner that the return valve closes automatically again.

From WO 2012/055901 a hydraulic hand-held device is known that has a pressure sensor which on reaching a limit pressure opens a magnetic valve. The limit pressure is defined by an insertable memory chip.

From WO 2008/138987 A2 it is known to determine a first workpiece contact in such a tool by means of a pressure sensor. Reference is also made to WO 2005/016375 A1 and US 2005/023570 A1.

Starting from the presented prior art, the invention is concerned with the object of providing a method for operating a hydraulically operated hand-held device or a hydraulically operated hand-held device which with a simple structure of the device allows the processing of different workpieces in particular with regard to size and/or material or simplifies the handling.

This task is solved by the hydraulic pressure acting on the return valve is increased to trigger a movement of the moving part into the end position independently of reaching the predefined working pressure, wherein an initial pressure increase moves a piston of the return valve from a valve seat, after which a return opening for the hydraulic medium is released and the returning hydraulic medium acts on a larger total piston surface of the return valve compared with a partial piston surface and thus also keeps the return valve in the open position with reduced or decreasing pressure.

With a view to the hydraulically operated hand-held device, in this respect, the focus is on the fact that a hydraulic pressure acting on the return valve can be increased to a pressure value which brings about an opening of the return valve independently of reaching the predefined working pressure, wherein the pressure increase is initial and moves a piston of the return valve from a valve seat to release a return opening for the hydraulic medium, wherein the returning hydraulic medium can act on a larger piston surface of the return valve compared with a partial piston surface and thus also keep the return valve in the open position with reduced or decreasing pressure.

The predefined working pressure is a hydraulic pressure which is set in the hydraulic medium by a working process, at which the return valve moves into the open position as a result of its constructive configuration. This hydraulic pressure is set when the return valve is closed in the hydraulic chamber which extends from the moving part as far as a closure surface of the return valve. The constructive configuration is preferably given by the fact that a partial piston surface of a valve piston sits in the valve seat in the closure state, i.e. forms the said closure surface. A specific hydraulic pressure is then required in order to raise the return valve from the valve seat by acting on this partial piston surface so that hydraulic medium, for example, in a hydraulic medium storage chamber can flow through the valve seat. The return valve is further preferably configured as a valve piston in such a manner that it has a total piston surface on which the hydraulic medium acts when the return valve is raised from the valve seat, i.e. is located in the open position. As a result of the size ratio between the total piston surface and the partial piston surface, in the open position of the return valve with respect to the partial surface, a comparatively very low pressure can be sufficient to keep the return valve in its open position. The area which the partial piston surface adds to the total piston surface can also be acted upon by hydraulic medium in the closed state of the return valve. However, not by the hydraulic medium contained in the hydraulic chamber ending at the said closure surface. In a practical design, for example, a pressure of 300 to 600 bar, further for example 400 to 500 bar with respect to the partial piston surface, can be required to raise the return valve from the valve surface whilst the total piston surface only requires a pressure of a few, for example, 5, 4 or fewer bar, possibly as far as 0.5 bar, for example, to remain in the open position. In a specific embodiment this pressure acting on the entire piston surface can for example be produced by a return spring acting on the moving part.

With a view to a design of the hand-held device as a hole-punching or punching device, the predefined working pressure is usually selected to be higher than the pressure required to perform the hole-punching or punching process. In this respect, the predefined working pressure can be set so high that the return valve only operates in the sense of an overpressure valve without further measures. The same fundamentally applies for example to a configuration of the hand-held device as a riveting device. Alternatively to this however the configuration of the hand-held device, in particular in the variants given as an example, can be provided so that when triggering the return valve as a result of the predefined working pressure, the moving part returns into its predefined initial position if no further intervention is made.

According to the innovation described here, a hydraulic pressure at which the return valve is moved into the open position can be achieved whereby an increase in pressure in hydraulic medium acting on the return valve is accomplished with an acting medium independently of a working process which is carried out with the hand-held device. This increase in pressure is accomplished in the hydraulic medium acting on the surface of the return valve which when the return valve is open, adds the partial piston surface to the total piston surface. When the return valve is closed, this hydraulic medium is fluidically separated from the hydraulic medium acting on the moving part. The action of pressure can optionally be given for a short time. The increase in pressure is selected so that the return valve is moved into the open position as a result. The pressure prevailing in the hydraulic medium acting on the moving part with a view to the moving part for carrying out the working process has usually not yet reached the predefined working pressure. It is therefore given that the return valve can be opened hydraulically before the predefined working pressure corresponding to the triggering pressure at the return valve is present at the moving part.

The return valve can be moved hydraulically into the open position independently of the prevailing working pressure at the moving part.

The return valve preferably only closes after a specific hydraulic pressure acting on the return valve has dropped so far that the pressure load required as a result of the constructive design of the return valve to keep the return valve in the open position is no longer given.

The return valve can be opened automatically at a working pressure which is variable, i.e. preselected and modified compared with the predefined working pressure, preferably as a result of a corresponding pressure application of the return valve.

Also the working pressure which is—only—achieved in a working process, can be set as a result as modified working pressure. Thus, a working pressure can further for example be predefined by the user as modified working pressure by means of an adjusting wheel or via buttons, which working pressure is lower than the maximum permissible working pressure. i.e., the aforesaid predefined working pressure at which the return valve preferably opens automatically or corresponds to this maximum working pressure. The latter can be appropriate for example if the said maximum working pressure is to be achieved actually but only with higher accuracy. Thus, for an exemplary predefined or maximum working pressure of 600 bar, optionally working pressures of 50 to 600 bar can be set continuously or in a stepped manner. A load adaptation to the processing of workpieces to be performed by means of the device can thus be made whilst maintaining an automatic return of the moving part into the end position after reaching the optionally set working pressure.

It can also be provided that the setting of the modified working pressure can be carried out outside of the hand-held device, for example via a radio interface or optical interface.

The increase in pressure is preferably only short. In terms of time the increase in pressure can only be effective in the range of a few tenths of a second. for example, over a time interval from 1/10 to 5/10 seconds.

The increase in pressure is in particular accomplished by supplying hydraulic medium into the given chamber downstream of the valve seat with a view to the drain direction of the hydraulic medium. This chamber which is also subsequently designated as valve chamber, is provided upstream of an opening of the return valve on the one hand by the total piston surface minus the partial piston surface and on the other hand by the surface of the valve seat facing the total piston surface including a delimiting surface of the pressure-increasing piston and optionally a surface of a line section given in this connection. The latter in any case insofar as the pressure-increasing piston is arranged directly as part of the valve chamber. It can also be separated from this, for example, by a check valve. Preferably no actual supply of additional hydraulic medium into the valve chamber takes place. A mere reduction in the size of the valve chamber by a movement of the pressure-increasing piston can be sufficient. The required increase in pressure can also be achieved by this means.

As a result of the additional pressure load behind the valve seat, an initial type of pressure increase to move the return valve into the open position on the one hand acts on the total piston surface of the return valve (minus the partial piston surface of a valve seat which is not yet effective at the instant of the pressure increase). This acts substantially decoupled as a result from the moving part since at the instant of the pressure increase, this is—only—subjected to the hydraulic pressure "upstream" of the valve seat (when viewed with a view to the flow direction of the hydraulic medium through the opened return valve). As a result, only a substantially lower pressure increase is required than upstream of the valve seat (when viewed with a view to the flow direction of the hydraulic medium through the opened return valve). Downstream of the valve seat a substantially larger area is given which acts on the return valve (see on this matter in detail said EP 0 944 937 B1 (U.S. Pat. No. 6,276,186 B1, U.S. Pat. No. 6,401,515 B2). The difference can in particular mean a factor of 100 or more. Therefore if 400 or 600 bar is required upstream of the valve seat for opening the valve, downstream of the valve seat a pressure of 6 bar or less, 4 or 2 bar for example can be sufficient for opening the return valve.

The initial type of pressure increase preferably moves a piston of the return valve from the valve seat, after which, as is known from the prior art, a return opening for the hydraulic medium is released and the returning hydraulic medium acts on the enlarged piston surface of the return valve compared with the valve seat surface, i.e. the partial piston surface and thus holds the return valve in the open position even with reduced pressure or decreasing pressure. The pressure increase to achieve the triggering pressure is accordingly preferably only accomplished over a (with the initial type discussed) time-limited range which only requires a time duration such that the piston of the return valve is raised from the sealing position.

The pressure increase can be accomplished by a movement of a pressure-increasing piston. Preferably this is a movable pressure-increasing piston which acts on the hydraulic medium.

In order to achieve an initial-type of pressure increase, the pressure-increasing piston should be moved abruptly. This can be accomplished manually by the user, for example, by means of an appropriately provided lever arrangement. An electromechanical displacement of the pressure-increasing piston is preferable in this respect.

The pressure-increasing piston can be moved in a hydraulic medium cylinder which is continuously connected hydraulically to a return line of the hydraulic medium. Thus the back-flowing hydraulic medium after opening the return valve preferably acts contrary to the direction of travel of the pressure-increasing piston with increasing pressure on the pressure-increasing piston. The back-flowing hydraulic medium can assist or bring about a back-displacement of the pressure-increasing piston into a base position. This is preferred however only when an application of pressure to the pressure-increasing piston is absent. In the case of an electromechanical displacement by an electromagnet, this is given for example when the magnetic force has decreased. The magnetic force decreases in the usual setting and preferably only when the return valve is again located in its closure position.

A negative pressure can also be produced by the back-displacement of the pressure-increasing piston in order to thus assist or actively trigger a closing process of the return valve. The said decrease in the magnetic force, in the case of the electromechanical configuration described can already be sufficient for such assistance or active triggering of the closing process. The fact that a return spring acting on the pressure-increasing piston is provided can also contribute to this. Optionally a further displacement of the pressure-increasing piston from the base position beyond the initial position can be accomplished contrary to the direction of the pressure increase in order to thus produce an optionally additional negative pressure and trigger or assist the closing process of the return valve. In this respect, reference is made to the initially mentioned DE 10 2008 028 957 A1 and the corresponding inclusion of the disclosure content in the present application. Consequently, as a result of the pressure increase described here by means of a pressure-increasing piston for specific opening of the return valve, at the same time a means is given which enables a specific closing of the return valve.

The pressure-increasing piston can be moved via a separate drive from a drive of the hydraulic pump. Both drives can be electromechanical drives. Preferably both drives are operated via a common power supply.

The pressure-increasing piston can be moved linearly by means of an adjusting magnet. In this respect, for example, a spindle drive can be provided for linear displacement of the pressure-increasing piston.

In a further development it is provided that the valve chamber is in communication with a hydraulic medium storage chamber via a separate check valve. This check valve opens when the pressure in the valve chamber decreases. For example, this check valve opens when the return valve closes or is closed in order to thus allow the pressure-increasing piston to move comparatively rapidly back into its initial position. If the return valve is open and the pressure of the returning hydraulic medium is present, this check valve is closed as a result. The draining of the hydraulic medium into the hydraulic medium storage chamber is accomplished via a drain opening released by the return valve.

In a further solution of the object, the focus is on the fact that on the hand-held device an adjusting device is provided for different working pressures predeterminable by the user, designed as an adjusting wheel, adjusting slide, and arrangement of a plurality of buttons, wherein each button is programmed with a predetermined working pressure, or as keypad with a display wherein the actually selected working pressure is shown on the display.

With regard to the hand-held device, the focus is on the fact that a return of the moving part can be accomplished depending on a pressure value measured by the pressure sensor by a triggerable opening of the return valve and that the working pressure at which the opening of the return valve is triggered is adjustable.

As a result of the adjustability of the hydraulic or working pressure which acts on a workpiece or the like via a moving part, an adaptation for example to the workpiece circumstances which can be brought about by the user is in particular possible in the simplest manner. Thus, for example, softer, accordingly more easily deformable materials can be subjected to a lower working or hydraulic pressure compared with harder materials. Workpieces with different parameters can thus be processed with only one hand-held device.

With the adjustable working pressure, a working pressure can be selected which is different from the pressure in the hydraulic medium at which the return valve would be brought into its open position in any case as a result of its constructive design. On this matter, reference is made to the preceding explanations. This pressure at which the return valve is brought into the open position as a result of its constructive design is designated as the predefined working pressure. The selected set working pressure can however, as already explained hereinbefore, be selected to agree with the said predefined working pressure. Independently of the selected working pressure, however the predefined working pressure is maintained unchanged. It is only unimportant as long as a selected working pressure is provided below the predefined working pressure or if it is in agreement with this.

Setting of the selectable working pressure can optionally also take place via a non-mechanical interface, in particular a radio and/or optical interface to the device.

Another solution to the object is provided according to the method, in that the return of the moving part is brought about when initial contacting of the workpieces has been determined by the device.

With regard to the cancelling of the actuation of the manually operated switch to bring about the return of the moving part, it can also be further provided that an ending of the return of the moving part is achieved by another actuation. This can be achieved in particular whereby upon repeated actuation, the electrical voltage at the adjusting magnet which acts on the pressure-increasing piston decreases. This is in any case when the opening and/or closing of the return valve is performed as described above. The closing of the return valve can then be brought about by the back-displacement of the pressure-increasing piston which then occurs. This back-displacement which is only or definitively brought about by the pressure of the hydraulic medium flowing in the valve chamber when the return valve is open or flowing through the valve chamber into the hydraulic medium storage chamber then at the same time ensures such a pressure drop in the valve chamber that the return valve closes. A spring acting on the pressure-increasing piston in the direction of its initial position in which for example no magnetic force is acting can be provided as assistance.

Independently of repeated actuation of the manual-actuated switch, a drop in the application pressure acting on the pressure-increasing piston is usually obtained when a predefined end position of the moving part is reached. This corresponds to the operating mode of the previously known return valve according to the initially mentioned EP 0 944 937 B1.

By cancelling the actuation of the switch, not only an interruption of the forwards movement of the moving part is achieved but rather a return of the same in the direction of its base position.

The return can be achieved whereby the return valve which opens on reaching a predefined working pressure is displaced into an open position by means of one of the previously described measures which results in a return of the hydraulic medium acting on the moving part.

The opening of the return valve can however also be accomplished mechanically, for example electromechanically, for example depending on the detection of cancellation of the actuation of the switch. In this case, a direct action on the return valve is achieved, possibly via a linkage, if the return valve is configured as a valve piston for example via a relevant piston rod.

The actuation of the switch can be detected by sensors. For example, the motor current of a drive actuating the hydraulic pump can be monitored. This is particularly in the case where the operation of the hydraulic pump is directly dependent on the switch actuation. A cessation of the relevant motor current is assessed as cancellation of the actuation of the switch.

A signal for opening the return valve can be generated.

The opening of the return valve can furthermore be achieved, as is further preferred, by increasing the hydraulic pressure acting on the return valve. In this respect, reference is made to the previously set out statements.

With regard to initial workplace contacting a corresponding touch or proximity sensor can be provided. Also for this purpose the motor current of the pump drive can be monitored. Alternatively or additionally the signal of a pressure sensor recording the pressure in the hydraulic medium can be evaluated for this purpose.

With regard to the motor current or the pressure in the hydraulic medium, a recorded significant increase can be assessed as workpiece contact. The significant increase is characterized in particular in that a previously given approximately linear pressure increase is departed from during forwards movement of the moving part. Workpiece contact can then be assumed for example if, relative to a time unit, the motor current or the said pressure is 2 or more percent above a linear increase extrapolated from a preceding time unit. Such an increase by up to 10 or more, possibly up to 20 percent, can be assessed as contact with a workpiece. This is both with regard to an actually measured pressure and also with regard to the said motor current of the pump drive since with increasing resistance against the moving part, as is given by a workpiece contact, the pump must run with correspondingly increased force.

The pressure sensor, not only in connection with the last described embodiment is particularly preferably an electric or electronic sensor, further in particular a pressure sensor which performs a pressure measurement when the device is switched on continuously at specific time intervals. The time intervals can be in the range of a few seconds as far as a few tenths of a second. Preferably the time intervals are given in the range of one or a few milliseconds, for example, in the range between 1 and 200 ms.

If, in the course of carrying out for example a pressing, cutting or punching process for specific reasons, possibly in an emergency, a return is desired, it is sufficient to merely release the actuation switch. After this the moving part not only comes to a standstill but also moves back at the same time.

The return valve can for example also be displaced into the open position for triggering the return movement of the moving part via a piston rod connected directly to a valve piston as specified or a similar linkage, on which piston rod or linkage a servo motor acts.

It can further be provided that a complete return of the moving part is initially awaited before a next actuation is released. Thus, for example, a predefined fixed time interval of 5 or 10 seconds can be provided. Alternatively it can also be determined via the pressure sensor whether the return has (completely) taken place, A possible (additional) hydraulic pressure application of the return valve to trigger a movement of the moving part back into the end position enables energy-favourable operation. Since the device total need not operate until the triggering pressure of the return valve is reached, but the return can be specifically initiated when the envisaged processing is accomplished, in the case of a hand-held device operated with a rechargeable battery, significantly more processings can be carried out with a charged rechargeable battery than with a solution in which the fixed triggering pressure must be achieved in each work process.

In the known solutions, despite a pressure sensor being provided, the switch-off cannot always take place at the desired pressure. If for example a pressure of 230 bar is desired, if there is corresponding inertia, a pressure of for example 300 bar can then still develop. A switch-off at a certain pressure such as possibly the said 230 bar is particularly essential in connection with punched rivets since otherwise an overpressing of the rivets can take place according to the material. As a result of the short-term pressure increase acting on the return valve, a rapid pressure drop is achieved at the moving part in consequence of opening the return valve. The reaction, i.e. the opening of the return valve, takes place in a time interval of one or several tenths of a second, in each case up to one second. This can also comprise a time interval of a few milliseconds, for example, two, four or ten milliseconds.

The invention is explained hereinafter with reference to the appended drawings which merely show one exemplary embodiment. In the drawings:

FIG. 1 shows an overall view of a hydraulically operated hand-held device in the form of a pressing device;

FIG. 1*a* shows a portion of the hydraulically operated hand-held device in the form of a pressing device with an adjusting wheel;

FIG. 1*b* shows a portion of the hydraulically operated hand-held device in the form of a pressing device with an adjusting slider;

Figures 1, 1A, 1B:
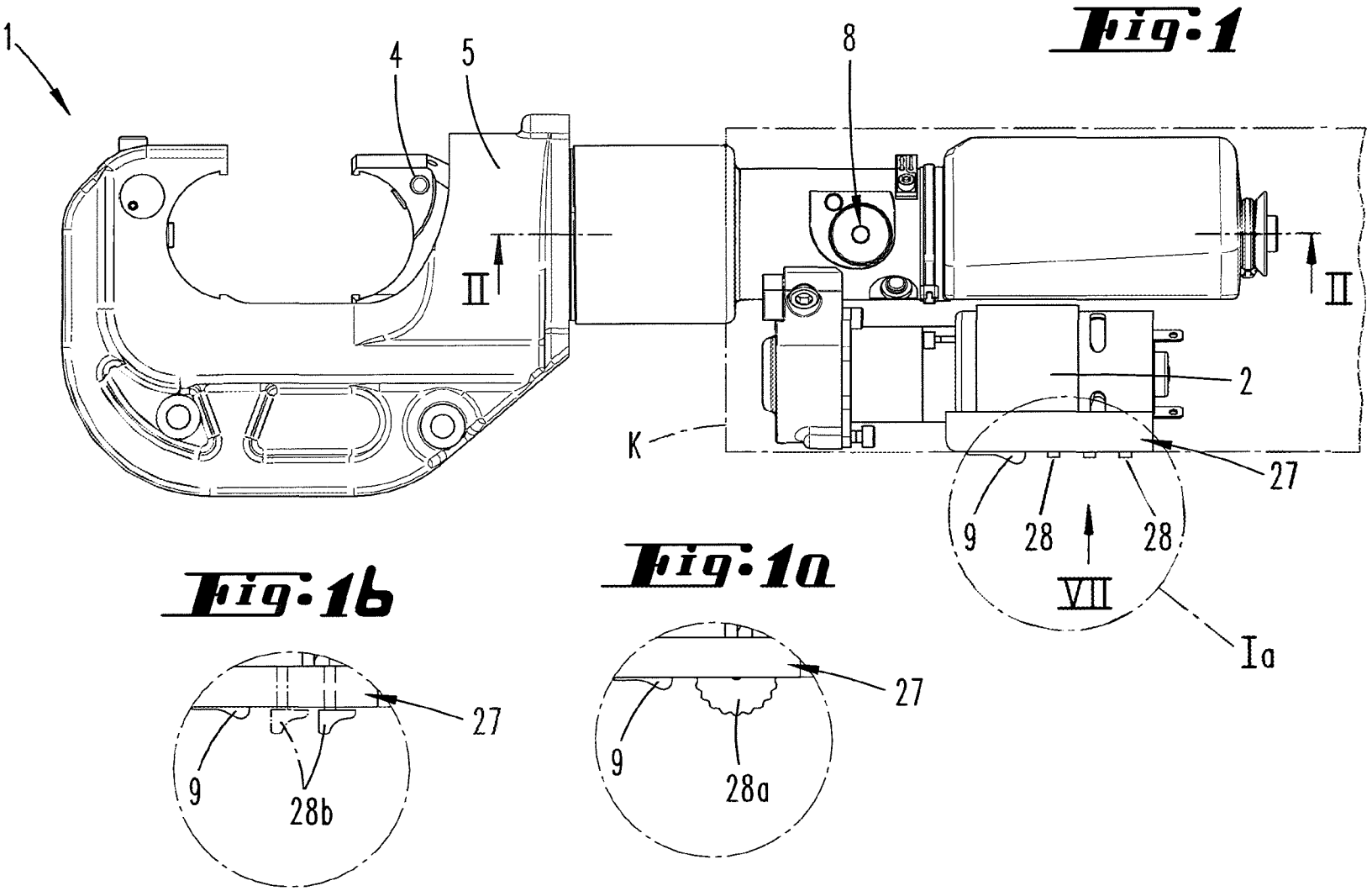

Shown and described initially with reference to FIG. 1 is a hydraulically operated hand-held device 1 in the form a pressing device with an electric motor 2, a hydraulic pump not shown in detail, a hydraulic medium storage chamber 3 and a moving part 4 configured as a hydraulic piston.

The moving part 4 is movable relative to a fixed part 5 formed by the device housing or for example the cylinder in which the hydraulic cylinder moves. The moving part 4 is now for example the tool holder shown in FIG. 1. It can for example also comprise the hydraulic piston (see possibly FIG. 2).

In particular, the components hydraulic medium storage chamber 3, return valve 8, adjusting device 27 and optionally others are accommodated in a device body K not shown in further detail here.

The hydraulic chamber 6 comprises the chamber into which the hydraulic medium is pumped. This begins on the pressure side of the hydraulic pump. As shown for example in FIG. 2, the hydraulic chamber 6 has a return line 7 via which the hydraulic medium can flow back via a return valve 8 into the hydraulic medium storage chamber 3.

Figure 4:
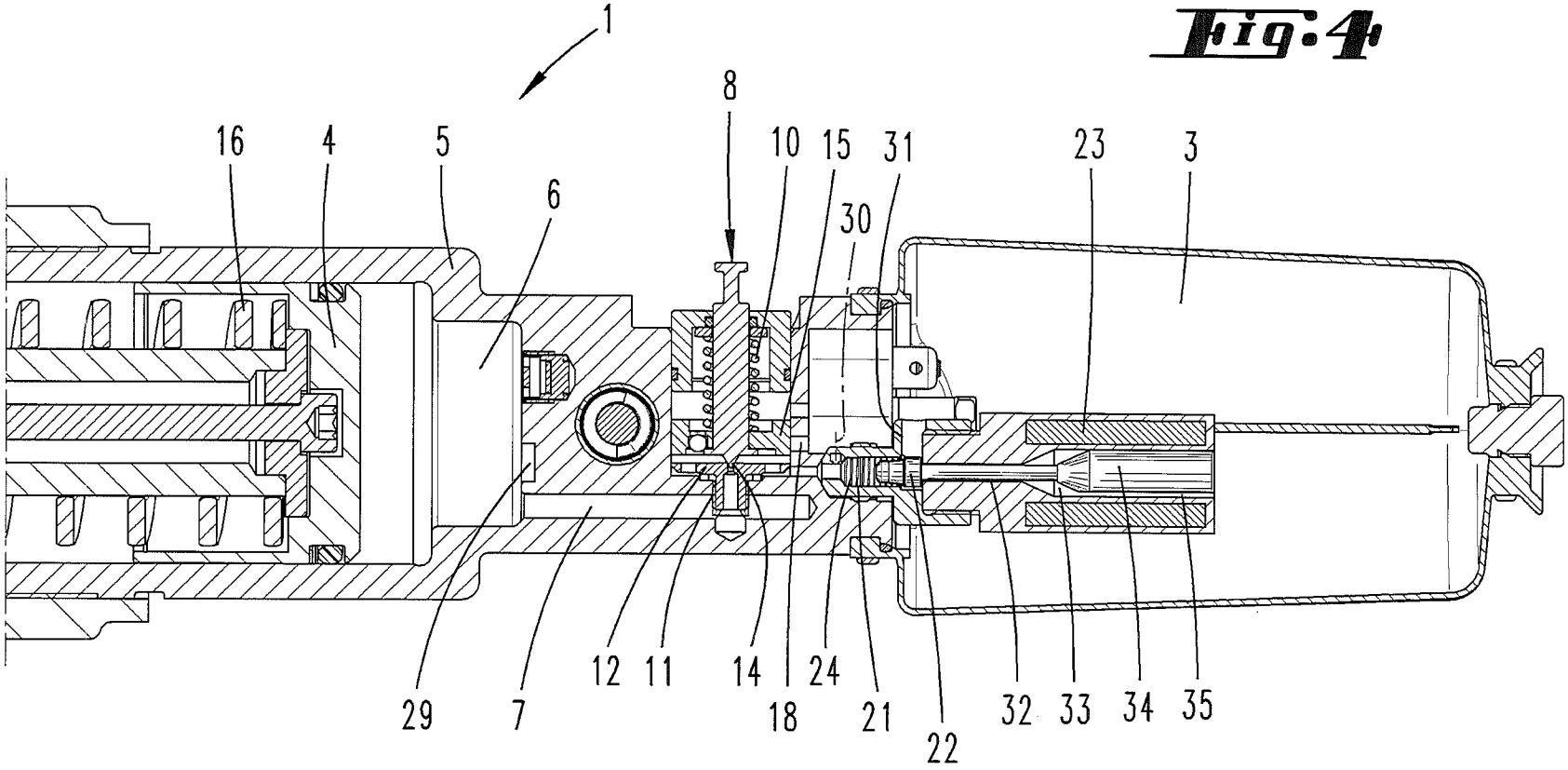
FIG. 4 shows a diagram corresponding to FIG. 2 during movement of the moving part of the hand-held part into a working position.
Figure 5:
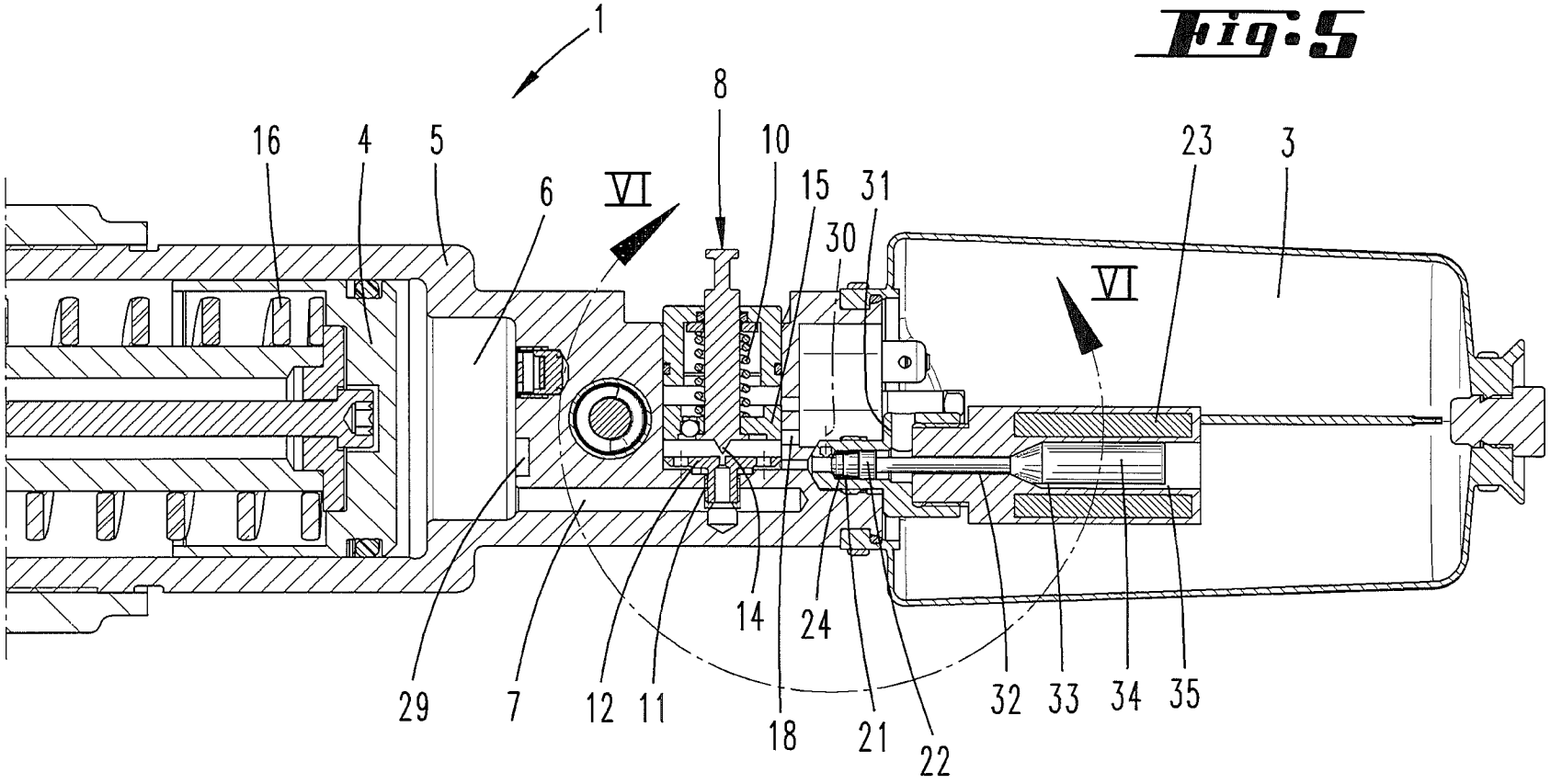
FIG. 5 shows a diagram corresponding to FIG. 4 with an opened return valve and actuated pressure-increasing piston.

As can be seen in particular from FIGS. 4 and 5, the hydraulic chamber 6 changes with the working state of the hand-held device 1. In the diagram according to FIG. 4, the moving part 4 is in a changed position compared with FIG. 2. After opening the return valve 8 (FIG. 5), the hydraulic piston or the moving part 4 moves back in the direction of its rest position according to FIG. 2. The space upstream of the hydraulic piston in this respect is included in the hydraulic chamber 6 but at the same time when the return valve is open, the passage through the valve seat and the space directly upstream of the return valve 8.

The electric motor 2 for operating the hydraulic pump and therefore for moving the moving part 4 in the direction of the working position is activated via a switch 9 preferably configured as a manually actuatable button. The power supply as well as further preferably a switch/control electronics is accomplished via a device-side rechargeable battery not shown or an electrical line.

In the valve closure position the return valve 8 is pressed into the valve seat by means of a pressure spring 10. The valve seat preferably consists in detail of a screw-in part 12 which is screwed into the housing of the hand-held device 1 via a thread 11.

A flow hole 13 is provided in the valve seat, optionally in the screw-in part 12. This is in fluidic communication with the return line 7.

As a result of the narrow cross-section of the flow hole 13 in the valve seat in cooperation with the pretension applied by the pressure spring 10, the return valve 8 only opens when a specific triggering pressure is exceeded. This is the initially mentioned predefined working pressure. This triggering pressure can for example be 600 or 700 bar.

After the return valve 8 has opened, the pressure of the hydraulic medium is no longer applied to the area corresponding to the cross-sectional area of the flow hole 13, a partial piston surface, given for example by a valve needle 14, but to the entire area (subsurface 17) facing the hydraulic chamber of the return valve piston 15 of the return valve 8 having the valve needle 14. The open return valve 8 is therefore already held in the open position by a very low pressure in the return line 7, for example a pressure of 2 to 5 bar.

The valve needle 14 need not be formed in an ideally tapering manner. Preferably it is formed to be conical in any case.

This pressure is preferably produced during the return of the moving part 4 by a spring 16 which acts on the moving part 4 and which loads the moving part 4 into the end position.

In the drain flow direction after the flow hole 13 the pressure is again significantly lower. For example, the pressure in particular at the beginning of the return of the moving part is only ¾ or less than the pressure upstream of the flow hole 13 or the valve seat, in practice for example approximately half. This pressure difference however substantially equalizes thereafter and is usually only comparatively low soon after the beginning of the return of the moving part.

After opening of the return valve 8, the chamber 26 adjoining the flow hole 13 as far as the subsurface 17 of the return valve piston 15 is included in the hydraulic chamber 6. The hydraulic medium then flows via a drain opening 18 into the storage chamber 3. The chamber 26 is also designated hereinbefore and hereinafter as valve chamber.

An axial hole 19 passing through the subsurface 17 and preferably rebound-protected, allows a backflow of hydraulic medium from the hydraulic medium storage chamber into the valve chamber 26 in the closure state of the return valve 8 according to FIGS. 2 and 3 in particular to facilitate a return of the pressure-increasing piston 22 (see on this matter further below).

Without any further measure, in particular without any external intervention, for example by the user, the hydraulic or triggering pressure which raises the valve needle 14 from the valve seat corresponds to the said predefined working pressure at the moving part 4.

However, a possibility has been provided for moving the return valve 8 into its open position without the hydraulic pressure required to raise the return valve 8 being present at the moving part 4. Accordingly, work, for example, pressings with the hand-held device 1 is possible which requires lower working pressures at the moving part 4 compared with the triggering pressure for the return valve 8.

For this purpose, preferably a further line 20 filled with hydraulic fluid is provided which is assigned to the hydraulic chamber adjoining the flow hole 13 in the downflow direction. This line 20 is continued in a hydraulic medium cylinder 21 in which the pressure-increasing piston 22 already mentioned is preferably linearly displaceable. The line 20 could also be configured to be shorter as shown or omitted.

By means of an electrically controllable adjusting magnet 23, a linear movement of the pressure-increasing piston 22 in the hydraulic medium cylinder 21 or in the line 20 can be achieved. The movement of the pressure-increasing piston 22 brought about by activation of the adjusting magnet 23 is preferably accomplished contrary to the force of a return spring 24 acting on the pressure-increasing piston 22.

Via the holes 25 provided for example in the screw-in part 12, preferably aligned in the direction of displacement of the return valve 8, the line 20 hydraulically forms a part of the valve chamber 26.

In the installed state the screw-in part 12 does not abut directly against the facing housing wall so that hydraulic medium moved by the pressure-increasing piston 22 can readily flow from the line 20 via the holes 25 into the part of the chamber 26 located downstream of the valve seat in the drain direction of the hydraulic medium.

The hand-held device 1 preferably has an adjusting device 27 by means of which the maximum working pressure present at the moving part 4 can be preset by the user. In the exemplary embodiment shown here, a multiplicity of buttons 28 (FIG. 1), an adjusting wheel 28*a* (FIG. 1*a*), and an adjusting slider 28*b* (FIG. 1*b*) are provided for this purpose, for which buttons predefined pressure values are stored. By means of the adjusting device, the previously described selected working pressure modified compared with the predefined working pressure (or even agreeing with this in individual cases) can be set accordingly. FIG. 1*b* shows the adjusting slider 28*b* in first and second positions. Reference is made at this point to the further, optionally alternative possibilities of the initially mentioned radio connection etc.

Thus, for example, a working pressure of 200 bar or 300 bar resulting in a triggering of the return valve can be preselected.

An evaluation/control electronics evaluates pressure measured values of a pressure sensor 29 in the course of the movement of the moving part 4 in the direction of the working position and compares this with the desired pressure value predefined via a button 28, the adjusting wheel 28*a*, or the adjusting slider 28*b*.

On reaching the desired pressure value, a corresponding signal is generated which results in an activation of the adjusting magnet 23.

Figure 6:
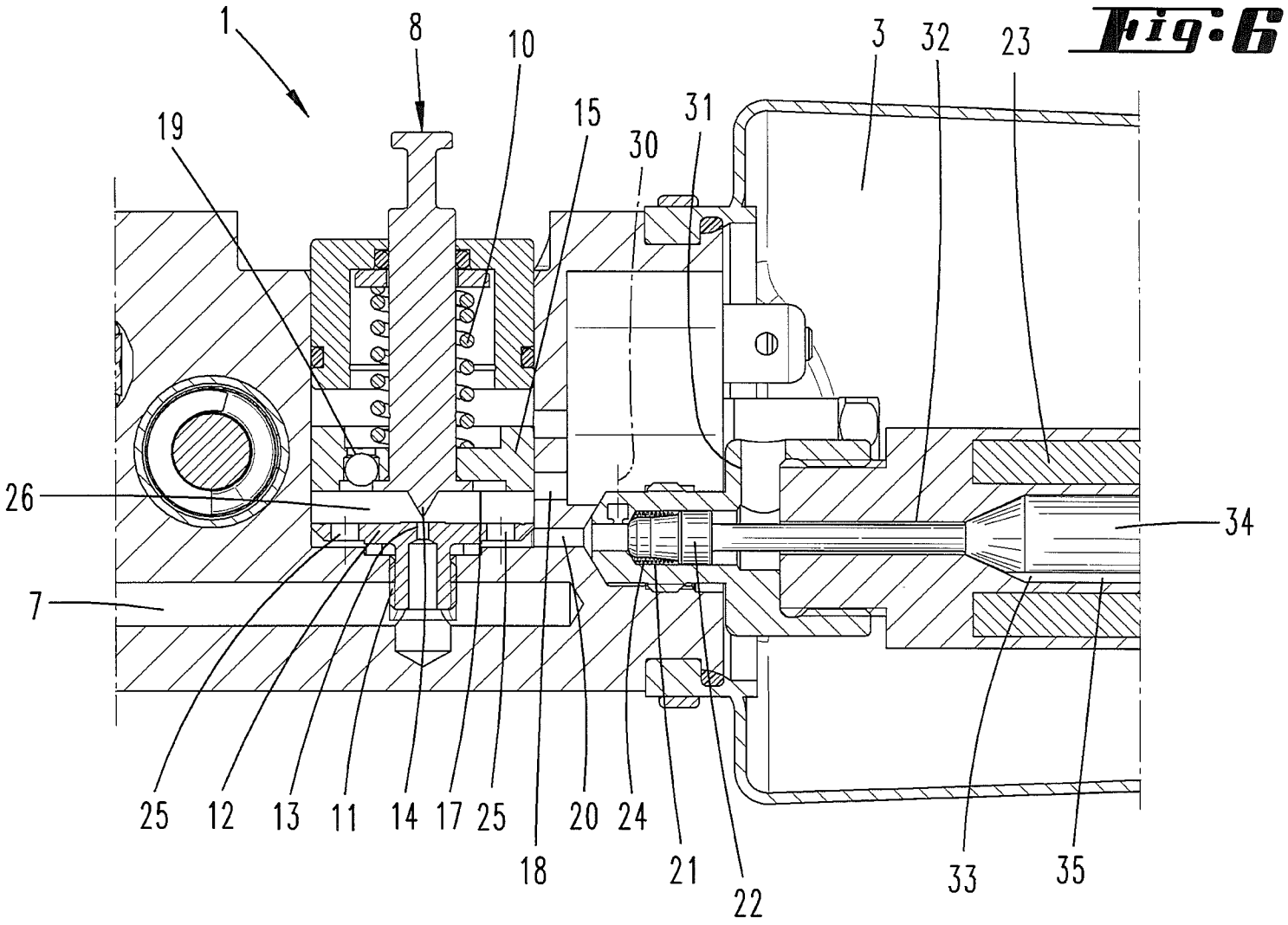
FIG. 6 shows an enlargement of the region VI in FIG. 5.
Figure 7:
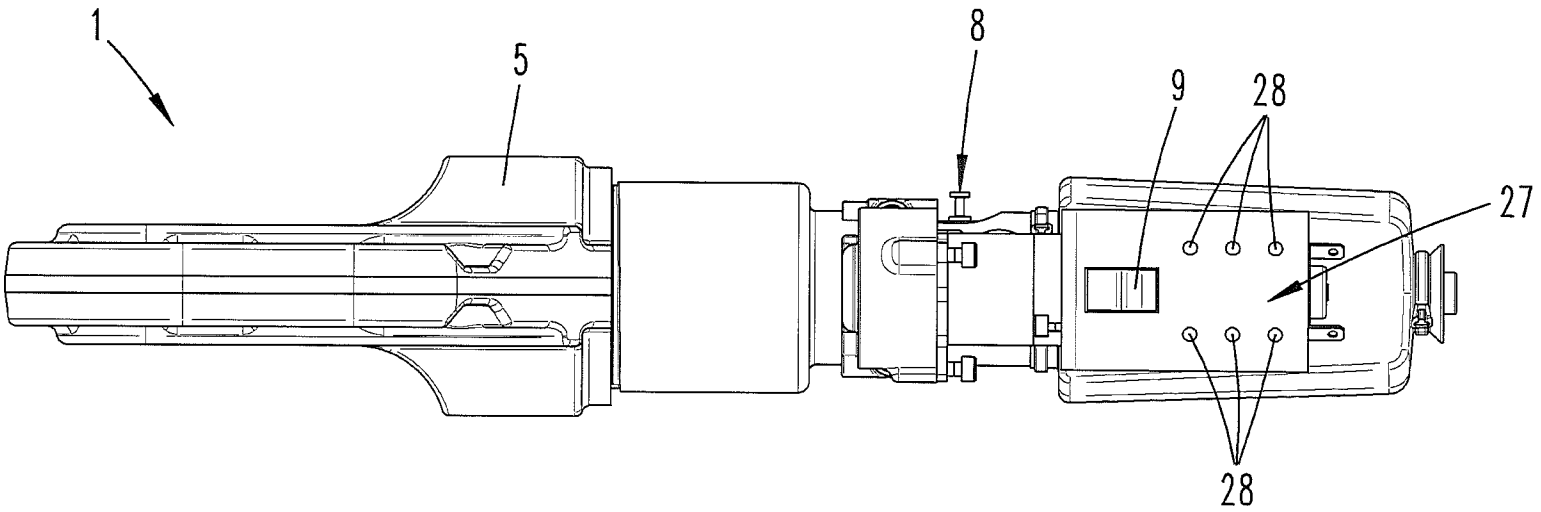
FIG. 7 shows the underview towards the hand-held device according to arrow VII in FIG. 1.

The pressure-increasing piston 22 moves as a result of the activation of the adjusting magnet 23 against the force of the preferably provided return spring 24 abruptly into the advance position according to the diagrams in FIGS. 5 and 6. As a result the pressure-increasing piston 22 moves into a close, almost circumferentially sealed cooperation with the hydraulic medium cylinder 21 of the line 20. Hydraulic medium located upstream of the pressure-increasing piston 22 is displaced in a direction of travel of the pressure-increasing piston 22 in the direction of the return valve 8 and thus in the depicted exemplary embodiment into the space "downstream" of the flow hole 13. It is therefore displaced relative to the closed state of the return valve 8 into the space formed by the subsurface 17 and the associated side of the screw-in part 12 as well as a part of the cylinder in which the return valve 8 is accommodated. This is the chamber 26 which has already been discussed, the valve chamber. As a result, this valve chamber is acted upon in the sense of a reduction in size. This results in a short-term pressure increase in the chamber 26 to act on the subsurface 17 of the return valve 8. As a result of the action of the substantially increased diameter area of the subsurface 17 compared with the cross-sectional area of the flow hole 13 in the valve seat, the return valve 8 can already be raised due to the build-up of a pressure of a few bar, for example 2 to 5 bar. This pressure is (initially) only achieved by the piston-like displacement of the pressure-increasing piston 22.

Figure 2:
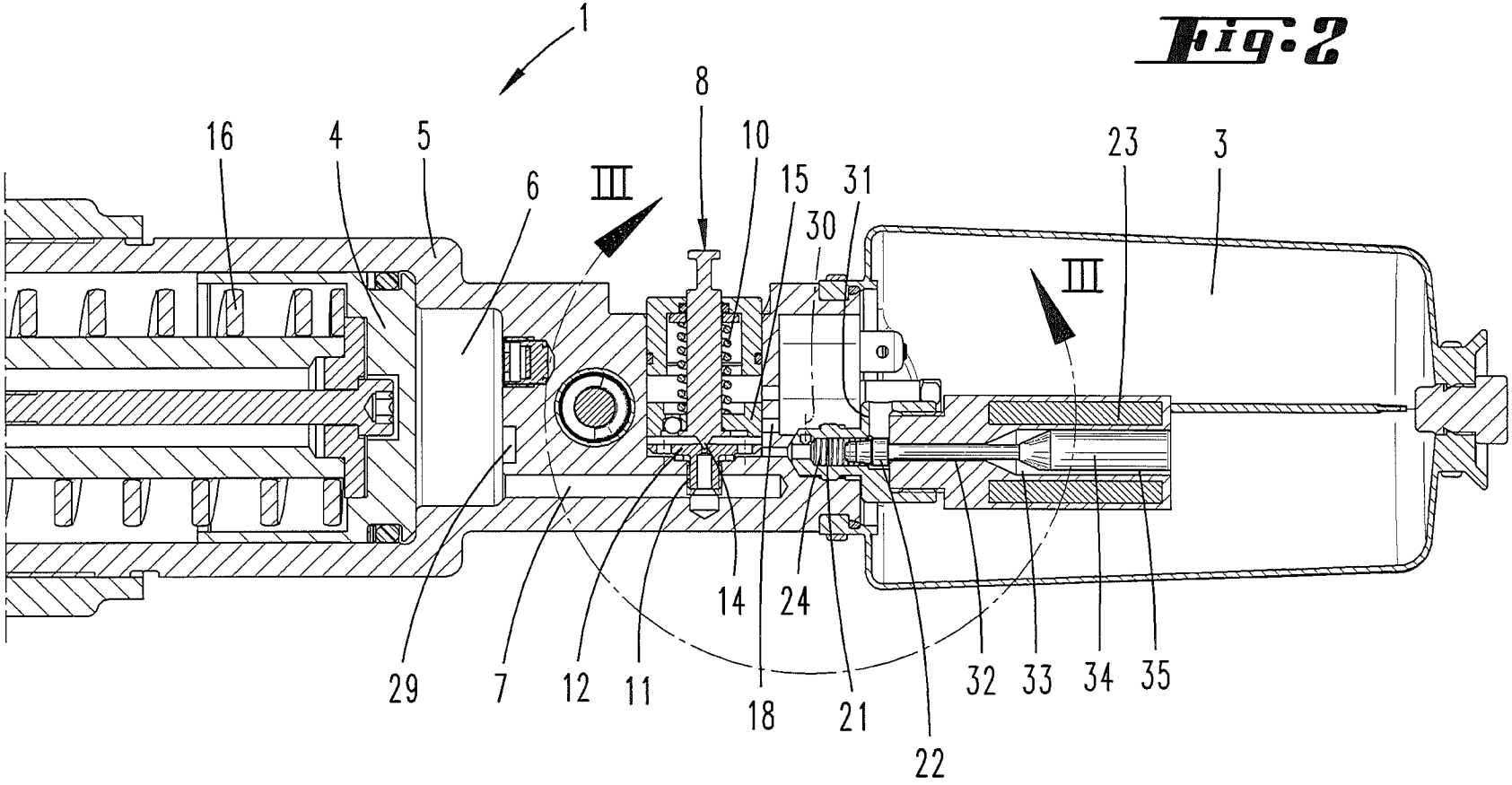
FIG. 2 shows the enlarged section according to the line II-II in FIG. 1.
Figure 3:
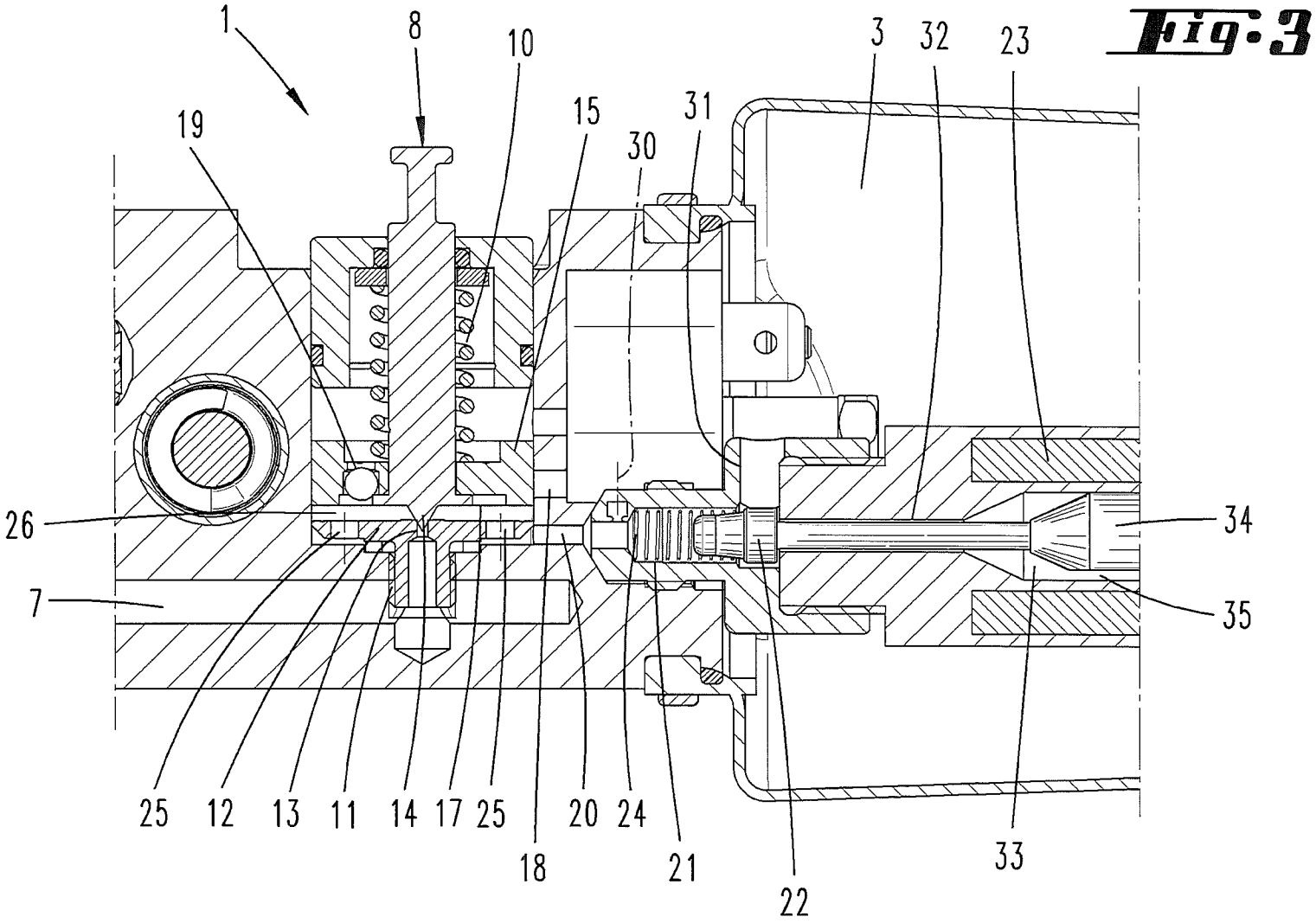
FIG. 3 shows an enlargement of the region III in FIG. 2.

The valve needle 14 is thereafter raised from the valve seat so that the hydraulic medium can return from the hydraulic chamber 6 back into the hydraulic medium storage chamber 3, wherein the return valve 8 is in this case held in the raised position until the moving part 4 reaches the end position according to FIG. 2 and thus the holding-open pressure for the return valve 8 is fallen below.

The pressure increase at the return valve 8 due to the pressure-increasing piston 22 acts in an initial manner. With raising of the return valve 8 and accompanying connection of the chamber 26 to the drain opening 18 with simultaneous opening of the flow hole 13, the pressure prevailing due to the return of the moving part 4 acts on the return valve 8.

The electrical action of the adjusting magnet 23 can initially take place in a pulsed manner so that after the complete initial stroke of the pressure-increasing piston 22, this is located almost immediately in the advanced position according to FIG. 6. With a regular sequence of a working cycle when in particular therefore no premature ending of the return of the moving part is desired, the pressure-increasing piston 22 preferably remains in this position as a result of action of the adjusting magnet 23 also occurring for this length of time.

As a result of an, as it were, premature cancellation of the action of the adjusting magnet 23 which has taken place before the complete return movement of the moving part, the pressure-increasing piston 22 can accordingly move back prematurely into its initial position. The associated increase in the valve chamber 26 can ensure a pressure drop such that a desired closure of the return valve 8 is achieved by this means.

With a return movement of the pressure-increasing piston 22, preferably at the same time a flow path from the hydraulic medium storage chamber 3 into the valve chamber 26 opens in order to supply the valve chamber 26 with the required hydraulic medium which enables the said backward movement of the pressure-increasing piston 22. As soon as the return valve 8 is closed again, no more hydraulic medium can flow into the chamber 26 via the valve seat. This flow path can be given by a check valve 30 arranged in the return valve piston 15 and/or a connecting path from the hydraulic medium storage chamber 3 to the line 20. Also with a return movement of the pressure-increasing piston 22 a (further) drain path for hydraulic medium into the hydraulic medium storage chamber 3 initially via a line section 31 which is released by the back-moving pressure-increasing piston 22, can be [provided]. Further however additionally or alternatively via a receptacle 32 for a piston shaft of the pressure-increasing piston 22. Via this and the preferably adjoining expanded space 33 in which an actuating piston 34 of the pressure-increasing piston 22 is located, hydraulic medium can drain directly into the hydraulic medium storage chamber 3.

In the actuated state, see FIG. 5 and in particular FIG. 6, it is also important that a front, here conically shaped surface of the actuating piston 34 abuts directly against the associated wall. On the other hand, the actuating piston 34 does not completely fill the expanded space 33 in the rearward direction hereto. As a result of a flattening or the like on one of its sides, on the contrary a free space 35 remains in the expanded space 33 in the advanced state during actuation according to FIG. 6.

The forwards movement of the moving part 4 into the working position is preferably only retained for as long as the user actuates the switch 9. In one embodiment with release of the switch 9 (even before completion of a working process) a signal is generated which results in a triggering of the adjusting magnet 23 and therefore via the pressure-increasing piston 22 results in a pressure increase in the chamber 26. Accordingly, with release of the switch 9 the return valve 8 is displaced into the open position which results in an automatic return of the moving part 4 into the end position.

The pressure-increasing piston 22 can be arranged transversely directed to the return valve 8. The longitudinal axes of pressure-increasing piston 22 and return valve 8 intersect outside the respective extension regions. This assists a desired compact design.

In addition, it can be provided as shown in the exemplary embodiment that the adjusting magnet 23 or the relevant structural section is flushed by hydraulic medium by projecting into the hydraulic medium storage chamber 3.

The preceding explanations are used to explain the inventions covered total by the application which in each case independently further develop the prior art at least by the following feature combinations, namely:

A method characterized in that the hydraulic pressure acting on the return valve 8 is increased to trigger a movement of the moving part 4 into the end position independently of reaching the predefined working pressure.

A method characterized in that the return valve 8 is opened automatically at a modified working pressure compared with the predefined working pressure.

A method characterized in that the modified working pressure can be set.

A method characterized in that the increase in the hydraulic pressure is accomplished for a short time.

A method characterized in that the increase in the hydraulic pressure is accomplished by supplying hydraulic medium into a given chamber 26 downstream of the valve seat with a view to a drain direction of the hydraulic medium.

A method characterized in that the increase in the hydraulic pressure is accomplished by a movement of a pressure-increasing piston 22.

A method characterized in that the pressure-increasing piston 22 is moved into a hydraulic medium cylinder 21.

A method characterized in that the hydraulic medium cylinder 21 is continuously connected to a return line 7 of the hydraulic medium.

A method characterized in that the hydraulic medium cylinder 21 is only hydraulically in communication with the return line 7 of the hydraulic medium when the return valve is open.

A method characterized in that the pressure-increasing piston 22 is moved via a separate drive from a drive of the hydraulic pump.

A method characterized in that the pressure-increasing piston 22 is moved by means of an adjusting magnet 23.

A method characterized in that a return of the moving part 4 is accomplished depending on a pressure value measured by the pressure sensor 29 by subsequent automatic opening of the return valve 8 and that the working pressure at which the opening of the return valve 8 is triggered is adjustable.

A method characterized in that when the actuation of a switch or button by the user is cancelled, an opening of the return valve and a return of the moving part 4 is triggered at the same time.

A method characterized in that the return of the moving part 4 is only triggered when a first workpiece contact has been determined previously on the device side.

A hand-held device characterized in that the hydraulic pressure acting on the return valve 8 can be increased independently of reaching the predefined working pressure to a pressure value which brings about an opening of the return valve 8.

A hand-held device, characterized in that a movable pressure-increasing piston 22 is provided to increase the pressure.

A hand-held device characterized in that the pressure-increasing piston 22 is movable in a hydraulic cylinder 21 which is continuously hydraulically in communication with a return line 7 of the hydraulic medium.

A hand-held device characterized in that the pressure-increasing piston 22 is movable by means of a drive separate from a drive of the hydraulic pump.

A hand-held device characterized in that the pressure-increasing piston 22 is movable by means of an adjusting magnet 23.

A hand-held device characterized in that the hydraulic volume which can be used to increase the pressure value on the return valve 8 is in communication with the hydraulic storage chamber 3 via a check valve 30.

A hand-held device characterized in that a return of the moving part 4 can be accomplished depending on a pressure value measured by the pressure sensor 29 by a triggerable opening of the return valve 8 and that the working pressure at which the opening of the return valve 8 can be selected to differ from the predefined working pressure.

A hand-held device characterized in that an adjusting device 27 is provided for different selected working pressures.

A hand-held device characterized in that a return of the moving part 4 can be triggered by cancelling the actuation.

REFERENCE LIST

1 Hand-held device
2 Electric motor
3 Hydraulic medium storage chamber
4 Moving part
5 Fixed part
6 Hydraulic chamber
7 Return line
8 Return valve
9 Switch
10 Pressure spring
11 Thread
12 Screw-in part
13 Through hole
14 Valve needle
15 Return valve piston
16 Spring
17 Subsurface
18 Drain opening
19 Axial bore
20 Line
21 Hydraulic medium cylinder
22 Pressure-increasing piston
23 Adjusting magnet
24 Return spring
25 Hole
26 Chamber
27 Adjusting device
28 Button
29 Pressure sensor
30 Check valve
31 Line section
32 Receptacle
33 Chamber
34 Actuating piston
35 Free space
K Device body

The invention claimed is:

1. A method comprising:

providing a hand-held device comprising a hydraulic pump, a moving part, a fixed part and a return valve, comprising a valve seat, a valve piston configured to seat within the valve seat or be displaced from the valve seat upon being acted upon by hydraulic medium, and a valve chamber between the valve piston and the valve seat, wherein the valve piston includes a partial piston surface and a total piston surface which is greater than the partial piston surface, wherein the partial piston surface is configured to seat within the valve seat in a closure state of the return valve and the valve piston and thereby the partial piston surface is configured to be displaced from the valve seat in an open state of the return valve;

displacing the moving part into a working position by filling a hydraulic chamber of the hand-held device with hydraulic medium from a storage chamber to build-up hydraulic pressure in the hydraulic chamber using the hydraulic pump, wherein the moving part is configured to be automatically moved from the working position into an end position by displacing the valve piston and thereby the partial piston surface from the valve seat to the open state by the hydraulic medium acting on the partial piston surface of the valve piston when a predefined working pressure is reached to open a return opening for the hydraulic medium to flow back into the storage chamber; and displacing the valve piston from the valve seat prior to reaching the predefined working pressure by filling the valve chamber with hydraulic medium at a selected hydraulic pressure in the hydraulic chamber which is less than the predefined working pressure and thereby opening the return opening for the hydraulic medium to flow back into the storage chamber, wherein the hydraulic medium flowing back into the storage chamber acts upon the total piston surface of the valve piston thereby holding the return valve in the open state.

2. The method according to claim 1, wherein displacing the valve piston from the valve seat occurs automatically and the selected hydraulic pressure is predefined.

3. The method according to claim 2, further comprising setting the pressure at a pressure which is less than the predefined working pressure prior to use of the hand-held device.

4. The method according to claim 1, wherein displacing the valve piston from the valve seat is carried out by moving a pressure-increasing piston.

5. The method according to claim 4, wherein during movement of the pressure-increasing piston, the pressure-increasing piston is moved into a hydraulic medium cylinder.

6. The method according to claim 5, wherein the hydraulic medium cylinder is continuously connected to a return line of the hydraulic chamber.

7. The method according to claim 5, wherein the hydraulic medium cylinder is only hydraulically in communication with a return line of the hydraulic chamber when the return valve is in the open state.

8. The method according to claim 4, further comprising driving the hydraulic pump to displace the moving part into the working position by using a drive; and moving the pressure-increasing piston by a drive which is a separate drive from the drive of the hydraulic pump.

9. The method according to claim 4, further comprising moving the pressure-increasing piston under action of a control magnet.

10. A hydraulically operated hand-held device comprising:

a device housing having a fixed part;

a hydraulic chamber within the device housing;

a storage chamber within the device housing;

a hydraulic pump operatively connected to the storage chamber and the hydraulic chamber;

a moving part attached to the device housing and movable relative to the fixed part of the device housing, wherein the moving part is configured to be moved into a working position by an increase in hydraulic pressure by filling the hydraulic chamber with hydraulic medium from the storage chamber using the hydraulic pump;

a return valve within the device housing, the return valve comprising a valve seat, the return valve configured to be opened to an open state upon application of a predefined working pressure applied to the return valve and further configured to be opened to the open state upon application of a selected hydraulic pressure which is less than the predefined working pressure applied to the return valve, wherein the moving part is configured to be automatically moved from the working position into an end position by opening the return valve when the predefined working pressure is reached;

a pressure sensor within the device housing and configured to measure pressure values of hydraulic fluid during movement of the moving part into the working position, wherein the moving part is configured to be returned to the end position upon measurement of a pressure value measured by the pressure sensor by movement of the return valve to the open state;

an adjusting device configured to set a value of the selected hydraulic pressure and comprising at least one of an adjusting wheel, an adjusting slider, a multiplicity of buttons, wherein each button is assigned a predefined working pressure, and a keypad and a display wherein on which the selected hydraulic pressure is configured to be shown; and evaluation/control electronics configured to evaluate pressure values measured by the pressure sensor during movement of the moving part into the working position and to compare the evaluated pressure value with the value of the selected hydraulic pressure.

11. The hand-held device according to claim 10, wherein the pressure sensor is configured to continuously measure pressure values of the hydraulic fluid during movement of the moving part into the working position at predetermined time intervals.

12. The hand-held device according to claim 11, wherein the time intervals are in a range between 1 and 200 milliseconds.

13. The hand-held device according to claim 10, further comprising a non-mechanical interface which is configured to set the predefined working pressure.

14. The hand-held device according to claim 13, wherein the non-mechanical interface is one of a radio interface with the hand-held device and an optical interface with the hand-held device.

15. The hand-held device according to claim 13, wherein the non-mechanical interface is a radio interface and an optical interface with the hand-held device.

16. A method comprising:

providing a hand-held device comprising a hydraulic pump, a moving part, a fixed part and a return valve comprising a valve seat and a valve piston configured to seat within the valve seat or be displaced from the valve seat upon being acted upon by hydraulic medium;

displacing the moving part into a working position by filling a hydraulic chamber of the hand-held device with hydraulic medium from a storage chamber to build-up hydraulic pressure in the hydraulic chamber using the hydraulic pump, wherein the moving part is configured to be moved from the working position into an end position by displacing the valve piston from the valve seat by the hydraulic medium acting on the valve piston when a predefined working pressure is, reached to open a return opening for the hydraulic medium to flow back into the storage chamber;

actuating one of a switch or a button by a hand of a user;

discontinuing the actuation of the one of the switch or button by the user, thereby opening of the return valve to allow movement of the moving part to the end position; and detecting contact with a workpiece by the moving part, wherein the movement of the moving part to the end position is only affected if contact with the workpiece has been detected.

17. A hydraulically operated hand-held device comprising:

a device housing having a fixed part;

a hydraulic chamber within the device housing;

a storage chamber selectively in communication with the hydraulic chamber;

a hydraulic pump operatively connected to the storage chamber and the hydraulic chamber;

a moving part attached to the device housing and movable relative to the fixed part of the device housing, wherein the moving part is configured to be moved into a working position by an increase in hydraulic pressure by filling the hydraulic chamber with hydraulic medium from the storage chamber using the hydraulic pump, and the moving part is configured to be automatically moved from the working position into an end position when a predefined working pressure is reached;

a return valve within the device housing, the return valve comprising a valve seat, a valve piston configured to seat within the valve seat or be displaced from the valve seat upon being acted upon by hydraulic medium, and a valve chamber between the valve piston and the valve seat, wherein the valve piston includes a partial piston surface and a total piston surface which is greater than the partial piston surface, wherein the partial piston surface is configured to seat within the valve seat in a closure state of the return valve and the partial piston surface is configured to be displaced from the valve seat in an open state of the return valve, the return valve configured to be opened to an open state upon application of the predefined working pressure applied to the return valve and further configured to be opened to the open state upon application of a selected hydraulic pressure which is less than the predefined working pressure applied to the return valve; and a pressure-increasing piston within the device housing, the pressure-increasing piston being movable relative to the device housing within a chamber in fluid communication with the valve chamber, wherein the pressure-increasing piston is configured to be moved within the chamber to increase hydraulic pressure acting on the return valve, wherein the hydraulic pressure acting on the return valve by the pressure-increasing piston can be increased independently of reaching the predefined working pressure to a pressure value which opens the return valve.

18. The hand-held device according to claim 17, wherein during movement of the pressure-increasing piston, the pressure-increasing piston is movable in a hydraulic medium cylinder.

19. The hand-held device according to claim 18, wherein the hydraulic medium cylinder is continuously hydraulically in communication with a return line of the hydraulic chamber.

20. The hand-held device according to claim 18, wherein the hydraulic medium cylinder is only hydraulically in communication with a return line of the hydraulic chamber when the return valve is in the open state.

21. The hand-held device according to claim 17, further comprising driving the hydraulic pump to displace the moving part into the working position by using a drive; and moving the pressure-increasing piston by a drive separate from a drive of the hydraulic pump.

22. The hand-held device according to claim 21, further comprising a control magnet configured to move the pressure-increasing piston relative to the device housing.

23. The hand-held device according to claim 22, further comprising a check valve in communication with the storage chamber and the return valve.

* * * * *